US006345862B1

(12) United States Patent
Meinburg

(10) Patent No.: US 6,345,862 B1
(45) Date of Patent: Feb. 12, 2002

(54) CONVERTIBLE BACKPACK CHAIR

(76) Inventor: Larry D. Meinburg, 1511 Shoshone St., Boise, ID (US) 83705

( * ) Notice: Subject to any disclaimer, the term of this patent is extended or adjusted under 35 U.S.C. 154(b) by 0 days.

(21) Appl. No.: 09/515,984

(22) Filed: Mar. 1, 2000

(51) Int. Cl.[7] ..... A47C 4/00
(52) U.S. Cl. ..... 297/55; 297/18; 297/118
(58) Field of Search ..... 297/4, 18, 16.1, 297/16.2, 55, 56, 118, 129, 354.13, 440.1, 447.2, 17, 94, 353, 311, 440.14; 224/155

(56) References Cited

U.S. PATENT DOCUMENTS

| | | | | | |
|---|---|---|---|---|---|
| 168,865 | A | * | 10/1875 | Bean et al. | |
| 759,676 | A | * | 5/1904 | Cook | |
| 1,342,650 | A | * | 6/1920 | Schlegel | |
| 1,608,911 | A | * | 11/1926 | Smith | |
| 3,250,449 | A | | 5/1966 | Woodman | 224/9 |
| 3,266,686 | A | | 8/1966 | Griffith | 224/9 |
| 4,322,109 | A | * | 3/1982 | Thebaud | |
| 4,392,598 | A | | 7/1983 | Dixon | 224/155 |
| 4,487,345 | A | | 12/1984 | Pierce et al. | 224/155 |
| 4,720,029 | A | | 1/1988 | Varanakis | 224/155 |
| 4,792,182 | A | * | 12/1988 | McLeod | |
| 4,836,938 | A | | 6/1989 | Kobasic | 224/155 |
| 5,046,651 | A | * | 9/1991 | Dagdagan | |
| 5,062,650 | A | * | 11/1991 | Chang | |
| 5,303,975 | A | | 4/1994 | Asato | 297/129 |
| 5,499,760 | A | | 3/1996 | Pielocik | 224/155 |
| 5,597,101 | A | * | 1/1997 | Barber et al. | |
| 6,092,866 | A | * | 7/2000 | Wu | |

* cited by examiner

*Primary Examiner*—Milton Nelson, Jr.
(74) *Attorney, Agent, or Firm*—Frank J. Dykas; Robert L. Shaver; Stephen M. Nipper

(57) ABSTRACT

A convertible backpack chair device is disclosed. The device has a first frame portion and a second frame portion. The two portions are independent of one another and are able to be slip fitted in a chair mode, a reclining mode, and a backpack mode. In the backpack mode, the second frame portion nests within the first frame portion for convenient carrying and storage. Backpack straps may also be present to facilitate convenient carrying.

13 Claims, 19 Drawing Sheets

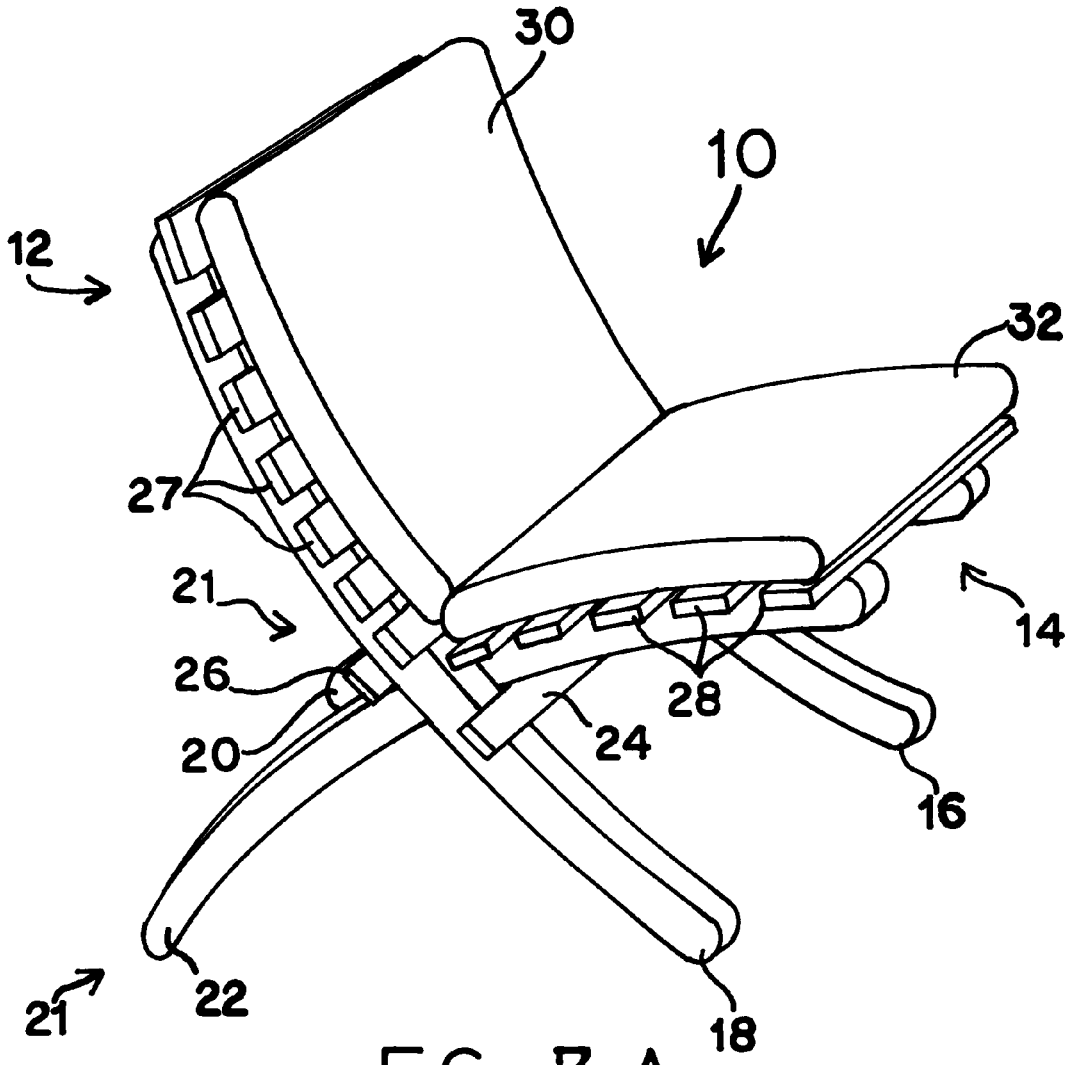
FG. 3A

CONVERTIBLE BACKPACK CHAIR

BACKGROUND OF THE INVENTION

Field of the Invention

The present invention generally relates to portable furniture, and more particularly to chairs that are able to be carried on a wearer's back.

Background Information

Many different types of chairs exist which are convertible from a backpack or carrying mode to a sitting or chair mode.

For instance, U.S. Pat. No. 5,303,975 to Asato shows a convertible backpack chair. The Asato chair has two frame portions joined by a pivot.

Another patent, U.S. Pat. No. 4,836,939 to Kobasic shows a multipurpose chair structure. The Kobasic chair is used in a chair mode by leaning a single frame against a tree or other support.

Varanakis, U.S. Pat. No. 4,720,029, shows a folding chair/backpack. The Varanakis chair folds through use of a pivot.

U.S. Pat. No. 3,266,686, to Griffith, shows a convertible pack and chair. The Griffith device has a pair of frames pivotally connected to one another.

Another U.S. Pat. No. 4,487,345, to Pierce et al., shows a backpack chair. The Pierce chair has multiple pivots.

Dixon, U.S. Pat. No. 4,392,598, shows a convertible backpack chair. The Dixon chair has a pivoting backrest.

Another patent, U.S. Pat. No. 3,250,449, to Woodman, discloses a convertible camping pack frame. The Woodman frame pivots from one mode to another.

Finally, U.S. Pat. No. 5,499,760 to Pielocik discloses an interconvertible backpack and chair apparatus. The Pielocik apparatus uses pivots to move from one mode to another.

What is needed is a convertible chair device having a pair of separate frame portions that are able to be connected together so as to form a sitting chair mode and connected together differently to form a backpack mode, where assembly of such modes is quick, easy and requires no tools.

Additional advantages and novel features of the invention will be set forth in part in the description as follows, and in part will become apparent to those skilled in the art upon examination of the following, or may be learned by practice of the invention. The advantages of the invention may be realized and attained by means of the instrumentalities and combinations particularly pointed out in the appended claims.

SUMMARY OF THE INVENTION

The present invention is a convertible backpack chair. In the preferred embodiment of the present invention, the convertible backpack chair consists of a back frame and a seat frame. This seat frame is able to nest inside the back frame in a backpack mode, and the seat frame is able to be denested and attached or slid into the back frame for converting the chair into a chair mode.

The back frame comprises a pair of generally parallel back legs. These back legs have a front, a back, a first side, a second side, a top end, and a bottom end. The sides define a back frame front, a back frame back, a back frame first side, a back frame second side, a back frame top end, and a back frame bottom end. The back legs are preferably concavely curved on their front side and convexly curved on their back side.

The back frame additionally has a plurality of parallel cross pieces spanning across or between the back legs. These cross pieces are normal to the back legs and attach to the front side of the back legs. The back frame also has a lower support piece which spans between the back legs. This lower support piece is parallel to the cross pieces and attaches to the back side of the back legs.

The seat frame is made of a pair of generally parallel seat legs. These seat legs have a front, a back, a first side, a second side, a top end, and a bottom end. These surfaces define a seat frame front, a seat frame back, a seat frame first side, a seat frame second side, a seat frame top end, and a seat frame bottom end.

It is preferred that these seat legs be concavely curved on their back side and convexly curved on their front side. The seat frame further comprises a plurality of parallel cross pieces which span between the seat legs. The seat frame cross pieces are normal to the seat legs and the seat frame cross pieces attach to the back side of the seat legs. It is preferred that the distance between the seat legs be such that allows the seat legs to nest between the back legs, being slid from the top end of the device to the bottom end of the device. This is so the back side of the seat frame nests with the back side of the back frame.

The seat frame attaches to the back frame in a nested fashion through the cross piece member located closest to the seat frame's bottom end resting upon the top surface of the lower support piece. Thus, the seat legs are held between the lower support piece and the bottom piece member located on the back frame to form a generally flat form for a carrying mode. In this mode, the seat frame is held attached to the back frame through friction and gravity.

It is also preferred that at least one shoulder strap attach to the backpack chair for allowing the chair to be carried on the user's back. In the preferred embodiment, the shoulder strap attaches to the back frame of the device.

The device can be converted into a cantilevered chair sitting mode by insertion of the ends of the seat legs through the back frame, so that the bottom end of the seat legs form the rear legs of the chair and the bottom ends of the seat legs form the front ends of the chair.

In another embodiment of the present invention, the convertible chair device is convertible from a chair mode to a carrying mode as well. The device of this embodiment has a first frame portion and a second frame portion.

The first frame portion has at least one elongated leg that extends therefrom. The first frame portion also has a first support portion for receiving therethrough at least one second frame portion elongated leg. Such receipt would be perpendicular so that the second frame portion is attached perpendicularly to the first frame portion. The first frame portion also has a second support portion, allowing at least one second frame portion elongated leg to be received therethrough. Such receipt will be in a generally parallel fashion.

The second frame portion is completely separate from the first frame portion. The second frame portion is not fixedly attached to the first portion. The second frame portion has at least one elongated leg extending therefrom. This elongated leg is for interfitting relationship with said first frame portion, either at the first support portion or the first frame portion second support portion.

The device is convertible to a sitting mode by insertion of the second frame portion elongated leg through the first portion of the first frame portion.

The device is convertible to a reclining mode by insertion of the second frame portion elongated leg beneath the lower support of the first frame portion.

The device is convertible to a carrying mode by insertion of the second frame portion elongated leg through the second support portion to form a cantilevered chair.

The device is also able to attach to a standard backpack, so that the wearer of the device could carry a backpack on the outside surface of the seat portion.

Still other advantages of the present invention will become readily apparent to those skilled in this art from the following detailed description, wherein we have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

BRIEF DESCRIPTION OF THE DRAWINGS

FIG. 3*a* is a perspective view of one embodiment of the present invention shown in its sitting chair mode.

DESCRIPTION OF THE PREFERRED EMBODIMENTS

Figure 1:
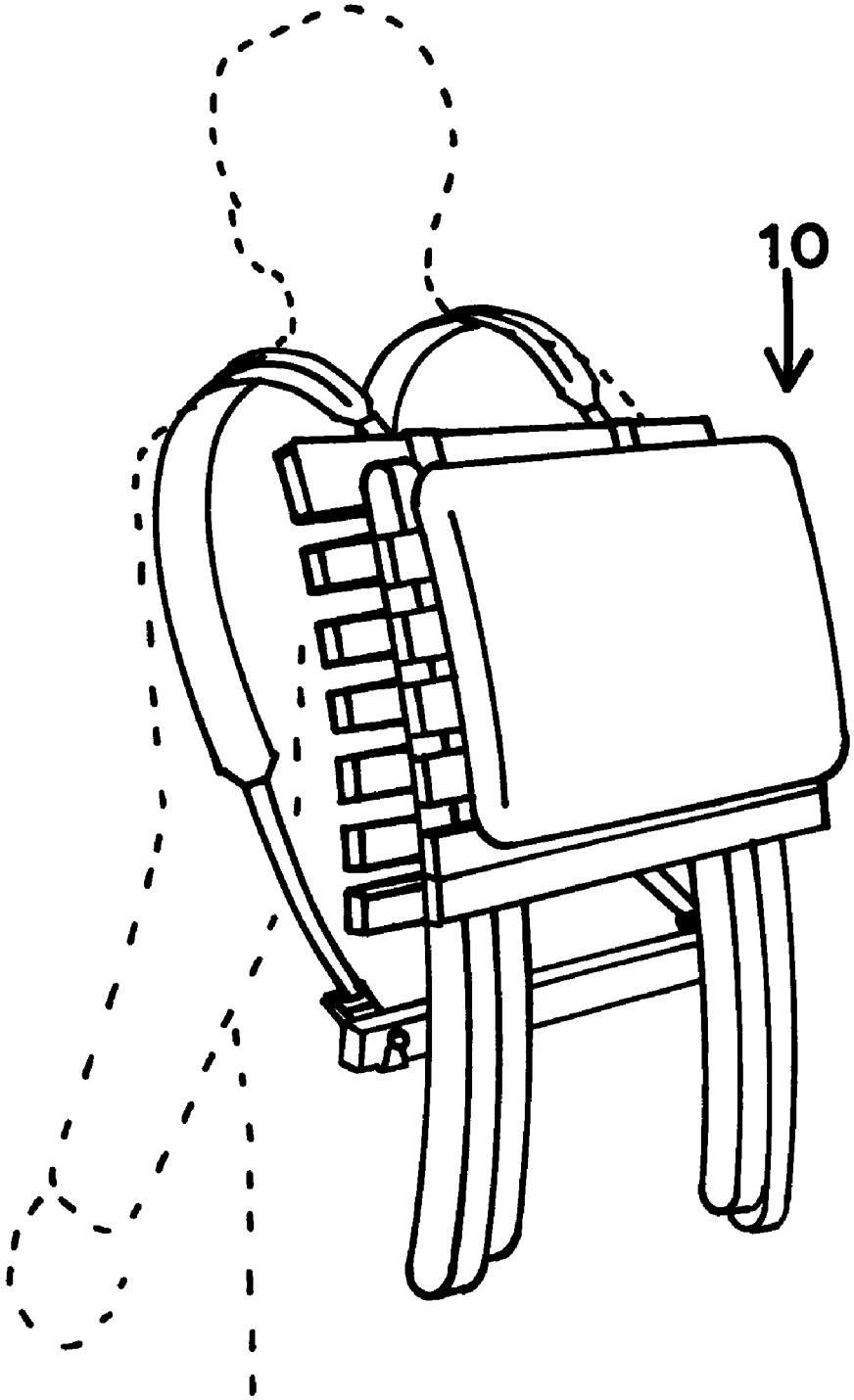
FIG. 1 is an environmental view of the one embodiment of the present invention being worn by a user in its backpack mode.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a convertible backpack chair. The device allows a user to take a chair and to carry it to a location to be used on the user's back. For instance, a hiker could strap on the backpack chair, hike up to a camp site and then set up the chair to sit in while at the camp site. This is very important in having both a dry and comfortable place to sit.

FIG. 1 shows one embodiment of the present invention 10 being worn on a user's back. In this embodiment, the device is being used in its backpack position.

Figure 2A:
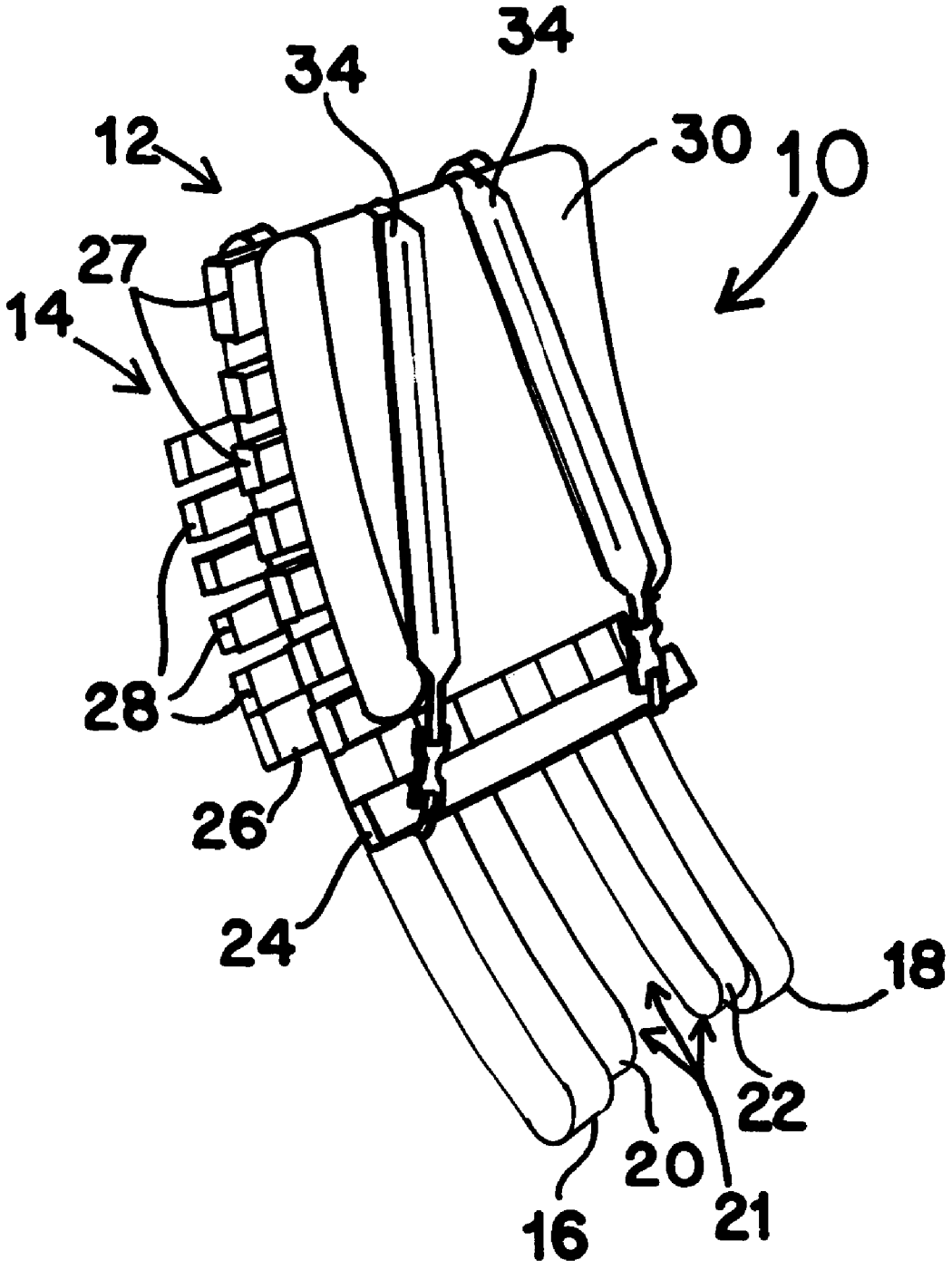
FIG. 2*a* is a perspective view of one embodiment of the present invention shown in its backpack mode.

FIG. 2*a* further shows the invented device 10 in its backpack position. The device 10 has a first frame portion or back frame 12 having a first outer leg 16 and a second outer leg 18. This back frame 12 has, extending between the legs 16, 18, a plurality of cross piece members 27. Also extending between the two legs are a lower support 24 and an upper support 26. The conjunction of the lower support 24, the upper support 26, the first outer leg 16 and the second outer leg 18 combine to form a first support position and a second support position.

The second frame portion or seat frame 14 has a first inner leg 20 and a second lower leg 22. Extending between these legs 20, 22 are a plurality of cross piece members 28.

As can be seen in this figure, the distance between the first inner leg 20 and the second inner leg 22 are such that the two legs 20, 22, will be able to jointly fit between the first outer leg 16 and the second outer leg 18.

Figure 2B:
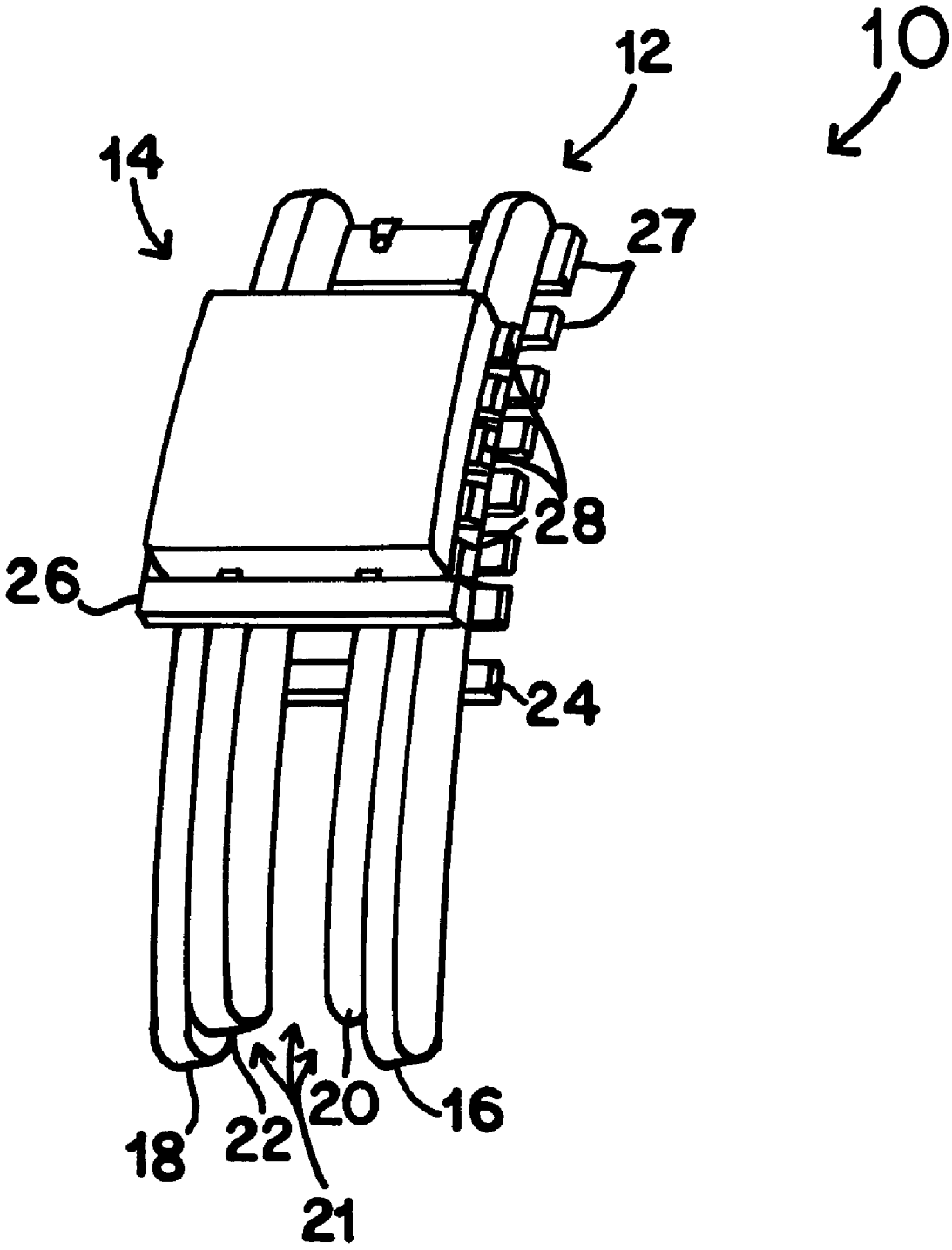
FIG. 2*b* is another perspective view of the embodiment shown in FIG. 2*a*.

When used in the backpack mode, as shown in FIGS. 2*a* and 2*b*, the ends 21 of the first inner leg 20 and the second inner leg 22 are slid into the second support position by sliding the seat frame 14 in a nested fashion so that the ends 21 and the inner legs 20, 22 slide between the upper support 26 and the lower support 24 in a generally parallel fashion with the first outer leg 16 and the second outer leg 18.

FIG. 3*a* shows the present invention 10 in the sitting chair mode. In this mode, the ends 21 of the first inner leg 20 and the second inner leg 22 are inserted through the opening between the first outer leg 16, the second outer leg 18, the lower support 24, and the upper support 26. This opening is better referred to as the second support portion 42. In such a configuration, the legs 20, 22, of the seat frame 14 are generally perpendicular to the length of the outer legs 16, 18. In this arrangement, the back cushion 30 and seat cushion 32 face one another to cooperate to form a seat on which the user will be able to sit.

Figure 3B:
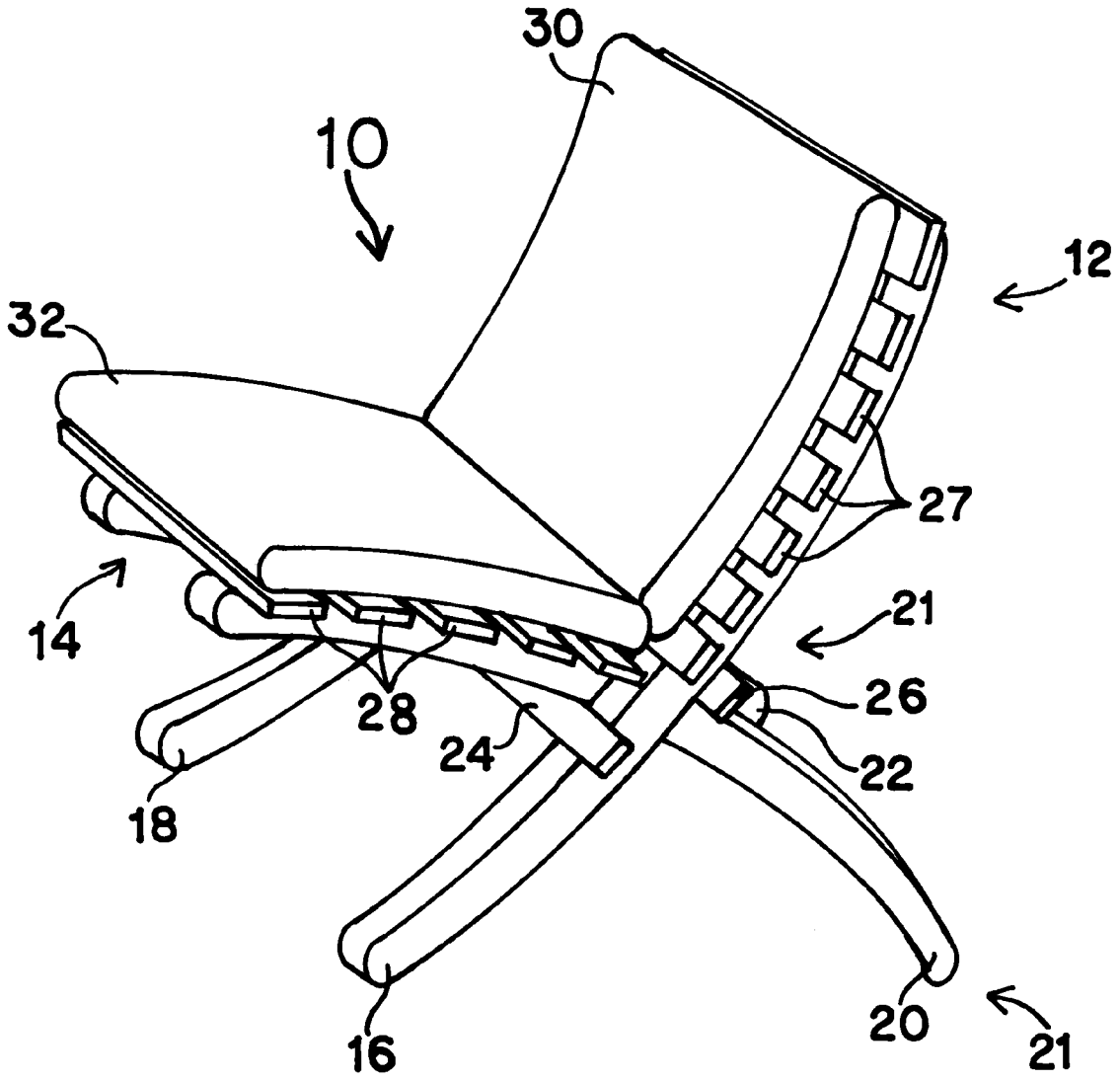
FIG. 3*b* is another perspective view of the embodiment shown in FIG. 3*a*.

FIG. 3*b* is generally an opposite side view of the embodiment of FIG. 3*a*.

As can be seen in FIGS. 3*a* and 3*b*, the back cushion 30 (if present) is supported by the cross piece members 27 and the seat cushion 32 (if present) is supported by the cross piece members 28.

Figure 3C:
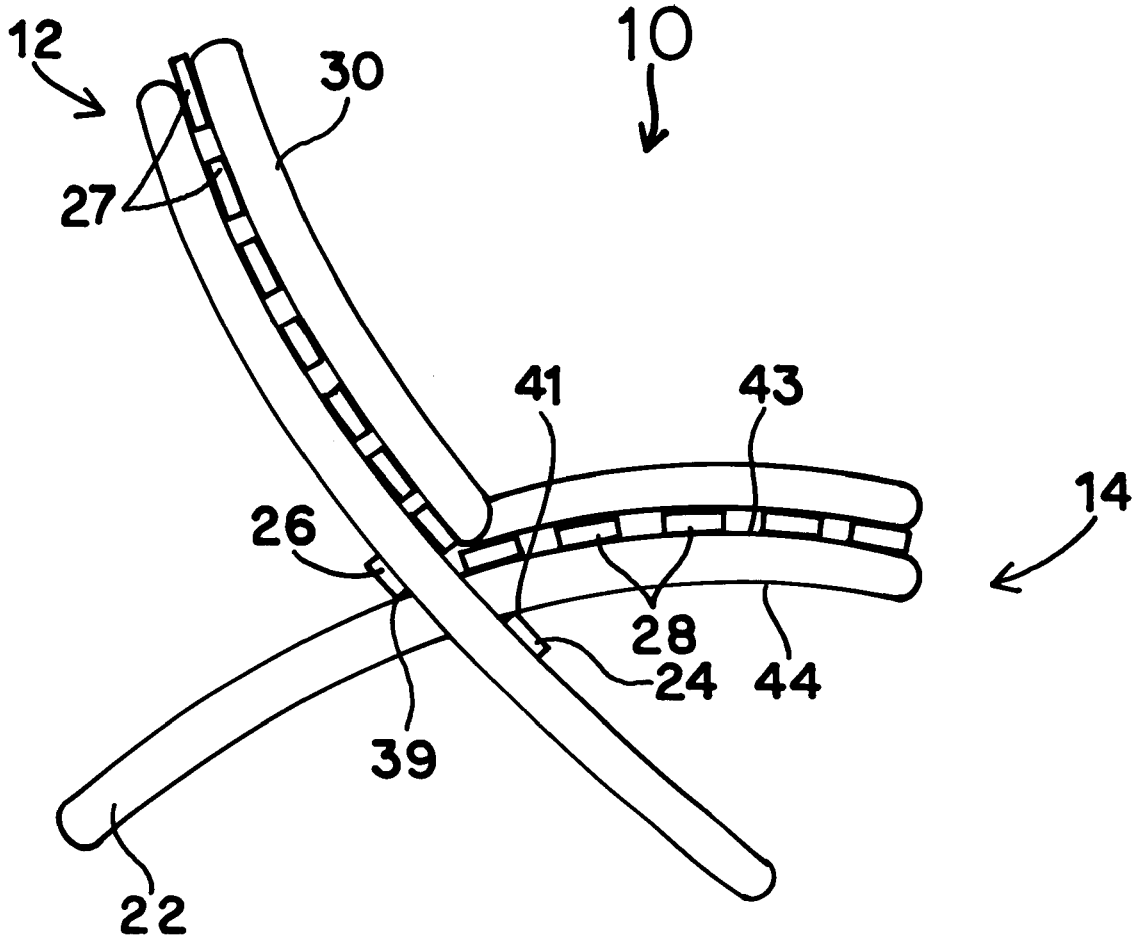
FIG. 3*c* is a partial side view of the embodiment shown in FIGS. 3*a*–3*b*.

FIG. 3C shows a partial view of the embodiments of FIGS. 3A–3B. In the seat mode, the configuration of the invented device 10 results in a cantilevered seat where the weight exerted downwards on the seat is transferred to both the lower support 24 and the upper support 26, thus resulting in a comfortable and stable seat. In such an arrangement, the legs 16, 18, 20, 22 are able to contact the ground of other surface.

Figure 4:
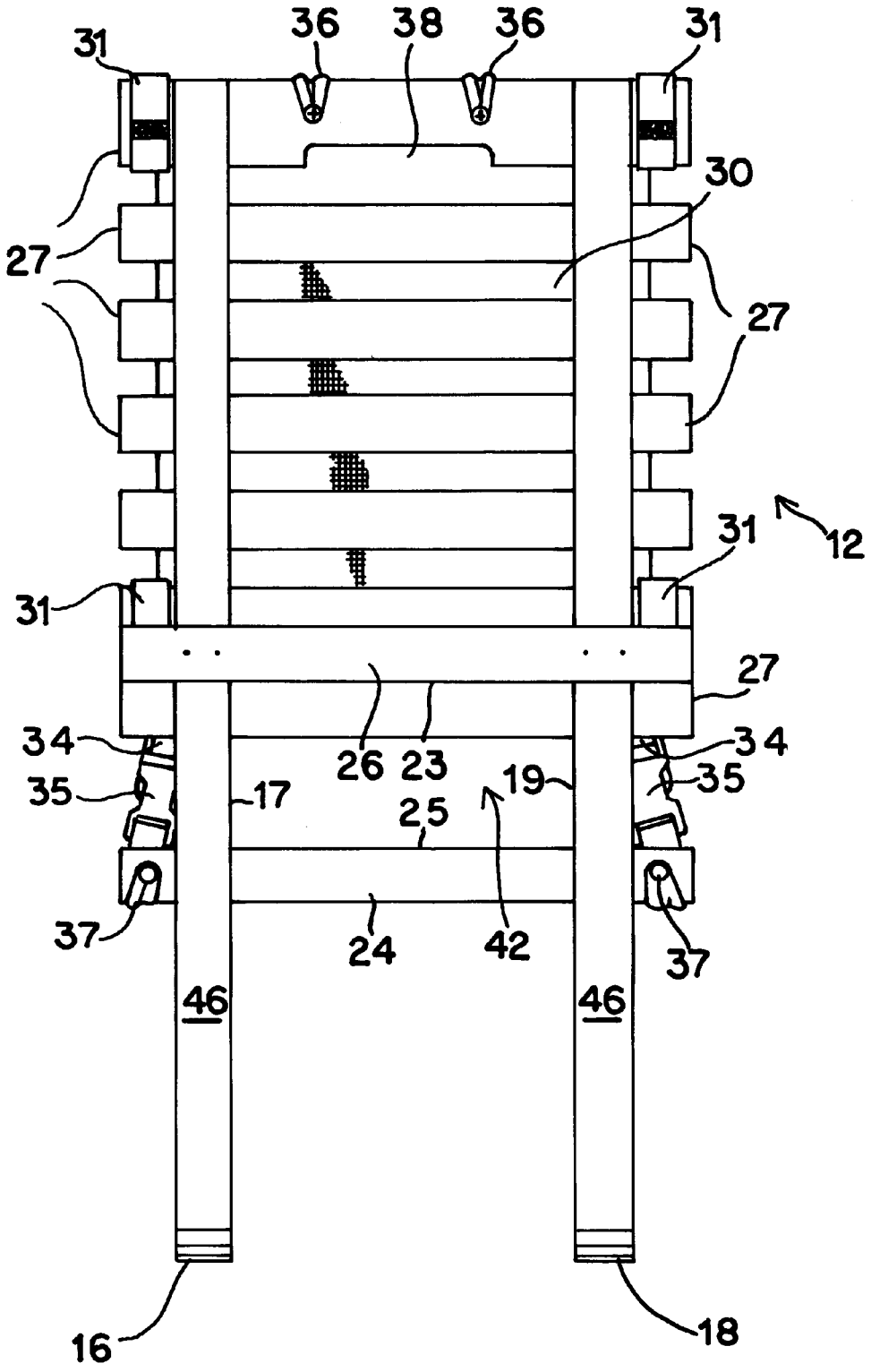
FIG. 4 is back side view of one embodiment of the first frame of the present invention.
Figure 8:
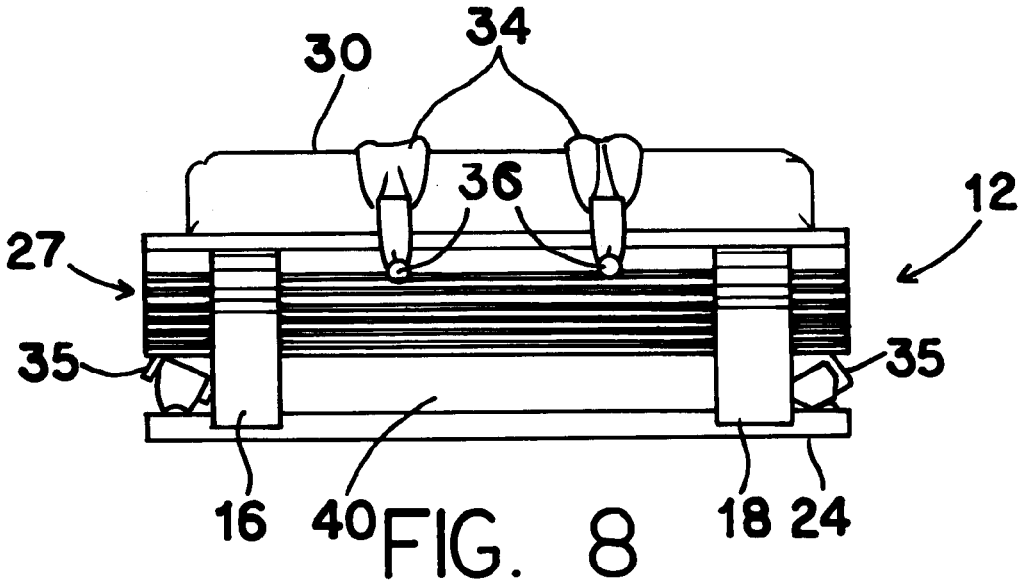
FIG. 8 is a top view of one embodiment of the first frame of the present invention.

FIG. 4 shows one embodiment of the first or back frame 12. The preferred embodiment of the back frame 12 is comprised of a pair of legs 16, 18 that are fixed in a generally parallel relationship through connections with cross piece members 27, lower support 24, and an upper support 26. Such an arrangement results in the formation of a first support portion 40 (as shown in FIG. 8) and a second support portion 42. In the preferred embodiment, this second support portion 42 is essentially an orifice for receiving the inner legs 20 and 22 of the second or seat frame 14. This orifice 42 is generally defined as the area bounded by the inner surface 17 of the first outer leg 16, the inner surface 19 of the second outer leg 18, the bottom surface 23 of the upper support 26, and the top surface 25 of the lower support 24.

Figure 6:
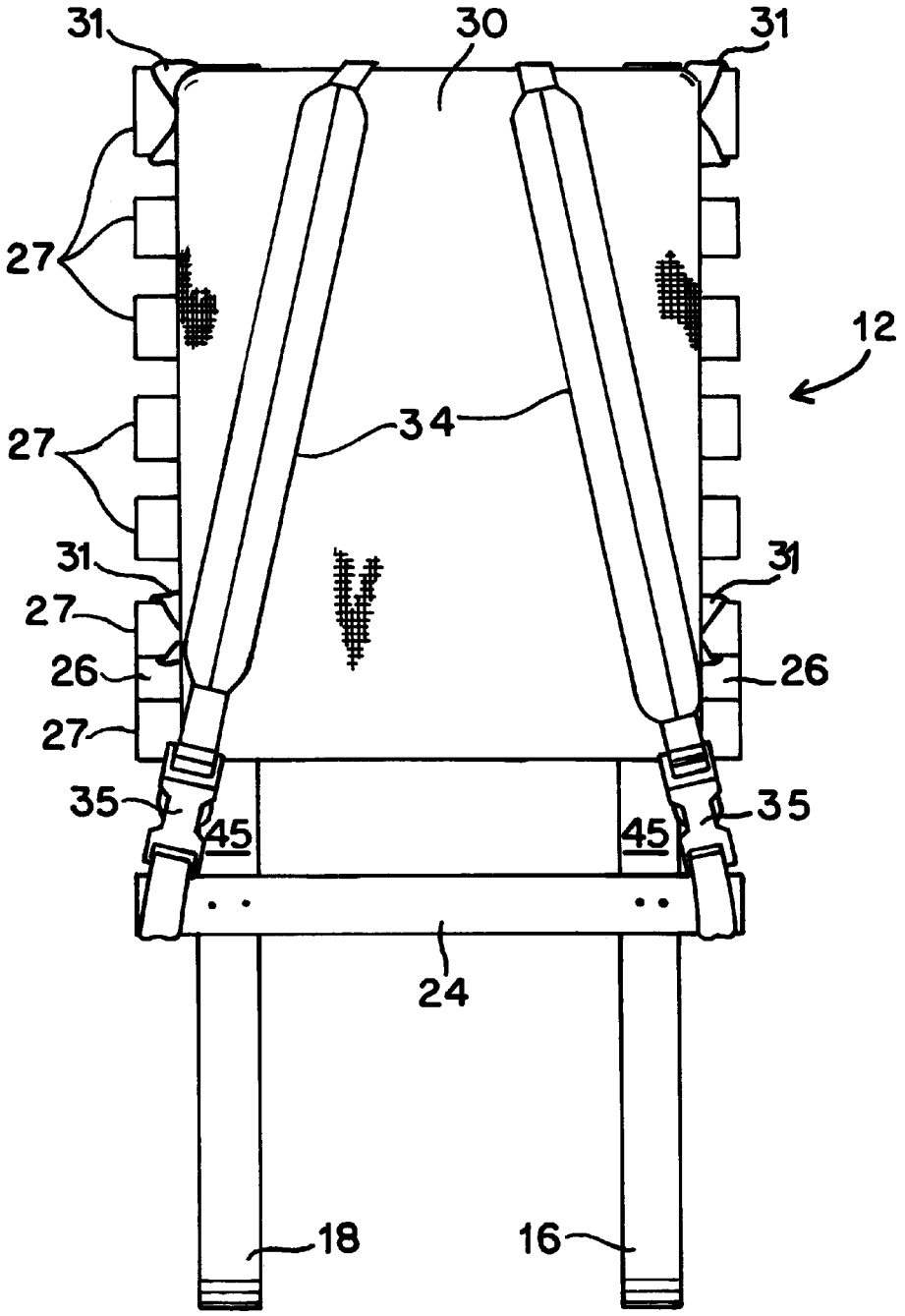
FIG. 6 is a front side view of one embodiment of the first frame of the present invention.

Preferably extending between the legs 16, 18 will be a plurality of cross piece members 27. These cross piece members 27 will be located on the back side surface 45 (shown in FIG. 6) of the outer legs 16, 18. Likewise, a lower support 24 is also located attached to the back side 45 of the outer leg. This back side 45 is shown in FIG. 6. The upper support 26 is attached to the front side 46 of the outer legs 16, 18. The lower support 24, the upper supports 26 and the cross piece members 27 are all generally parallel to one another and perpendicular to the outer legs 16 and 18.

The back frame 12 preferably also comprises a back cushion 30. This back cushion 30 is located on the back side of the back frame 12, as shown in FIG. 4. This back cushion 30 attaches to the back frame preferably through use of a releasable connection means such as hook and loop type fasteners 31. In the preferred embodiment, these hook and loop fasteners wrap around and secure to at least one of the cross piece members 27.

In the preferred embodiment, the back frame 12 also comprises at least one shoulder strap 44 (shown in FIG. 5A) for allowing the device 10 to be worn as a backpack. The shoulder straps 34 will preferably attach to the back frame 12 through use of shoulder strap first connections 36 and shoulder strap second connections 37. It is preferred that the shoulder straps 34 will be adjustable through use of a standard backpack adjustment device 35 so that a wearer will be able to adjust the device 10 for size. Also envisioned is providing a hand hold 38 for allowing the device 10 to be more easily carried.

Figure 5A:
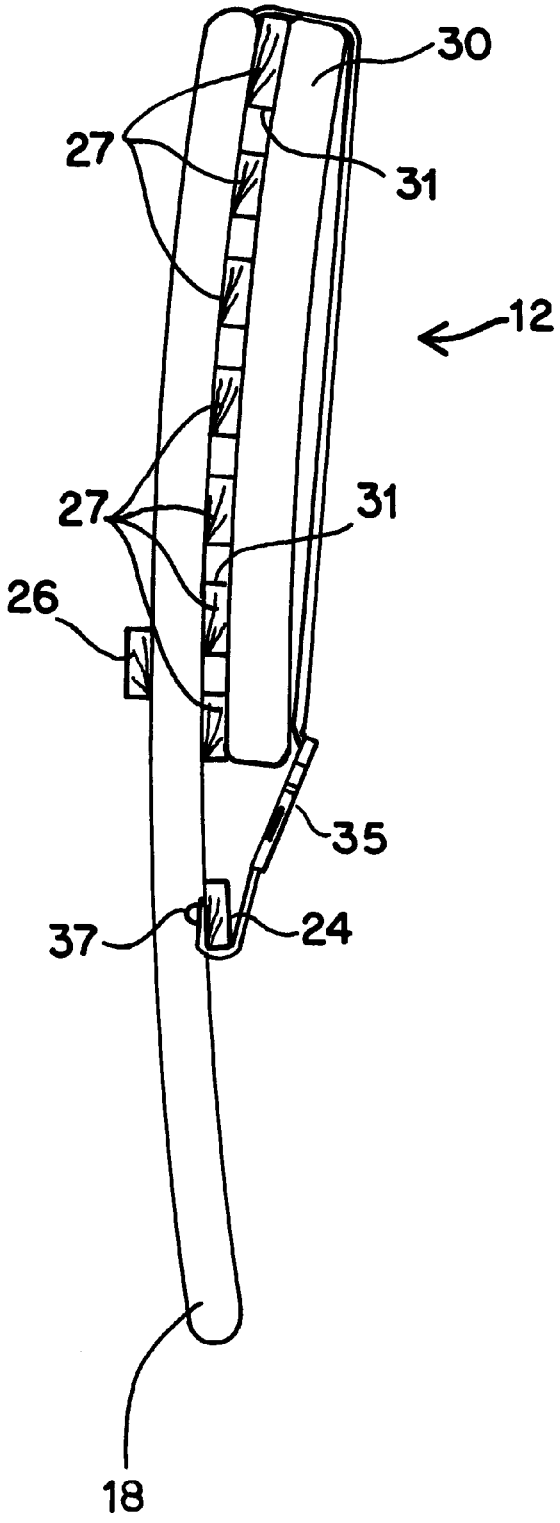
FIG. 5*a* is a side view of one embodiment of the first frame of the present invention.
Figure 5B:
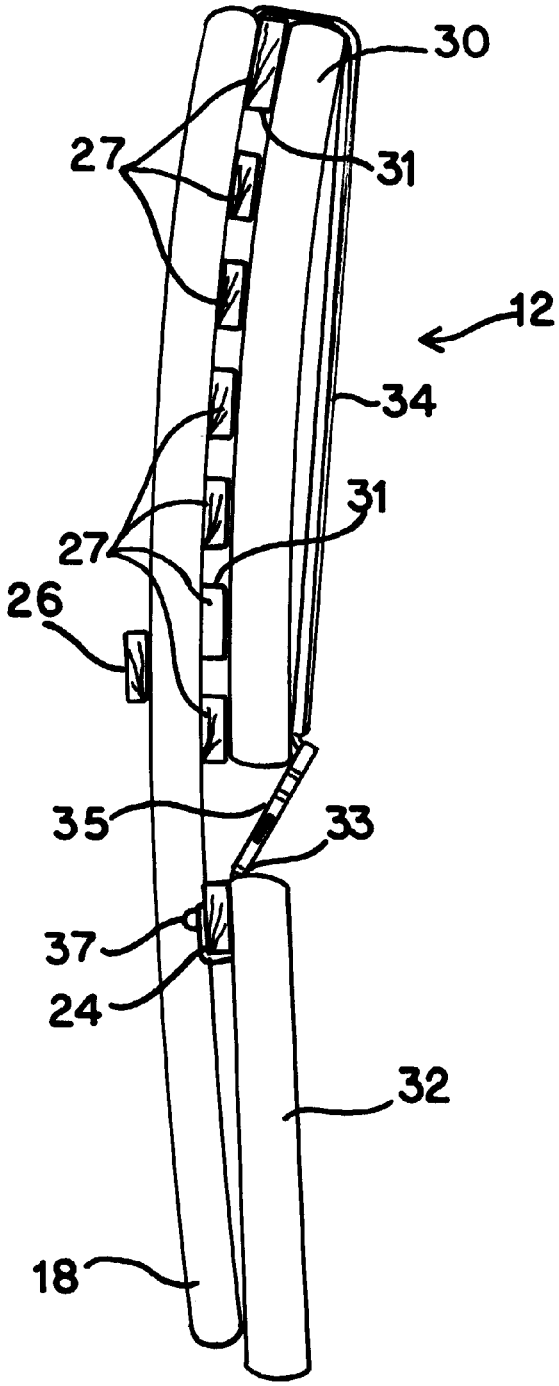
FIG. 5*b* is a side view of another embodiment of the first frame of the present invention.
Figure 7:
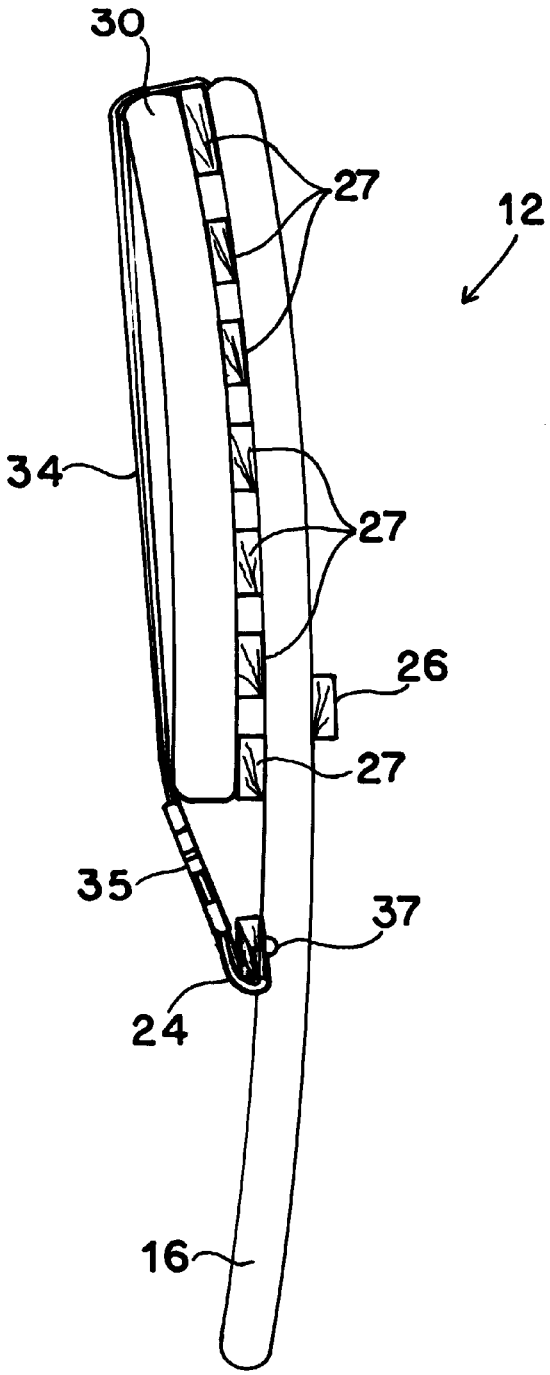
FIG. 7 is another side view of another embodiment of the first frame of the present invention.

Referring now to FIG. 5A and FIG. 5B, additional embodiments of the back frame 12 are shown. As shown in FIG. 5A, the first outer leg 16 and the second outer leg 18 are preferably slightly curved, so as to comfortably fit on a wearer's back. This curvature is also shown in FIGS. 5B and FIG. 7.

Referring to FIG. 5B, also envisioned is detaching the seat cushion 32 from the seat frame (as discussed infra) and attaching the seat cushion 32 through use of a releasable connection means 33 to the lower support 24. Such a connection would create a much more comfortable backpack for the wearer.

FIG. 6 shows a front side view of another embodiment of he back frame 12 of the present invention 10. This view more fully shows one embodiment of the envisioned shoulder straps 34.

Referring to FIG. 8, the first support portion orifice 40 can be clearly shown. It is into this first support portion 40 that the ends 21 of the first inner leg 20 and the second inner leg 22 can be inserted when the device 10 is being converted into the backpack mode.

Figure 9:
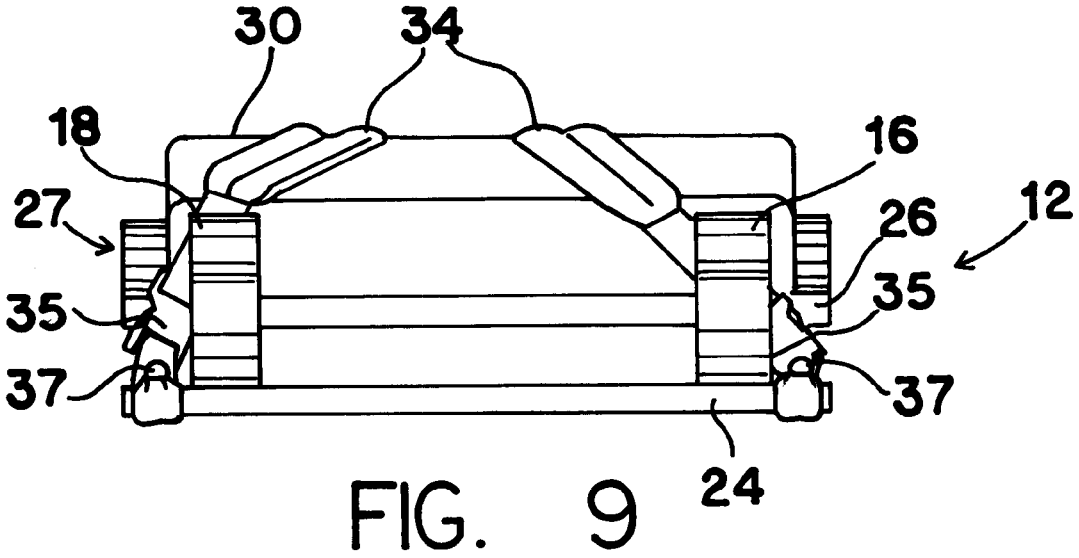
FIG. 9 is a bottom view of one embodiment of the first frame of the present invention.

FIG. 9 generally shows the backpack frame 12 from a bottom view.

Figure 10:
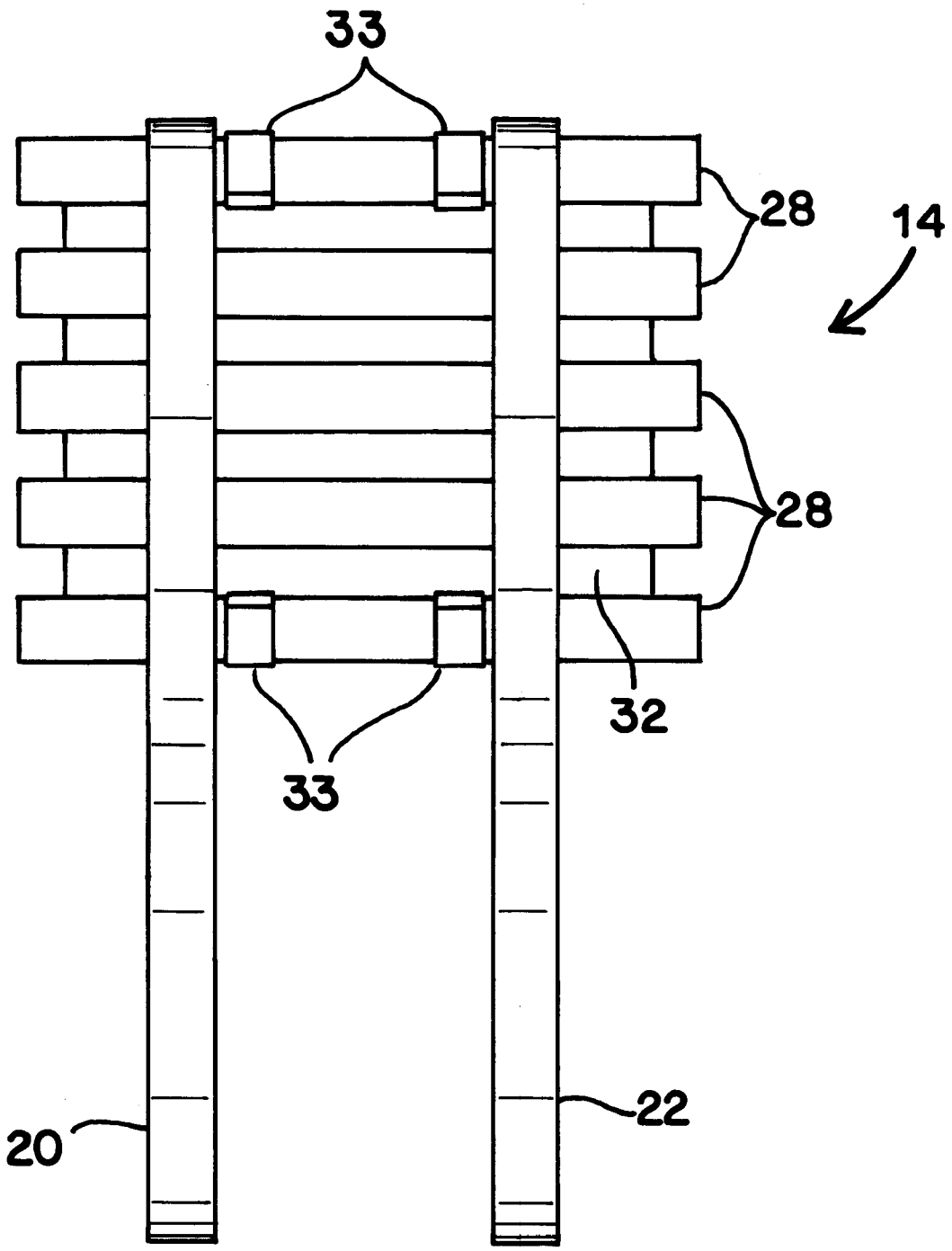
FIG. 10 is a back side view of one embodiment of the second frame of the present invention.

Now referring to FIG. 10, shown is the preferred embodiment of a seat frame 14. The preferred embodiment of the seat frame comprises a first inner leg 20 parallel to a second inner leg 22. These legs 20, 22 are fixed in place through their connection with cross piece members 28. These cross piece members 28 are preferably parallel to one another, and oriented perpendicularly with the legs 20 and 22. Attaching to the front side of the seat frame 14, is preferably a seat cushion 32. Such connection is done through releasable connection means 33.

Figure 11:
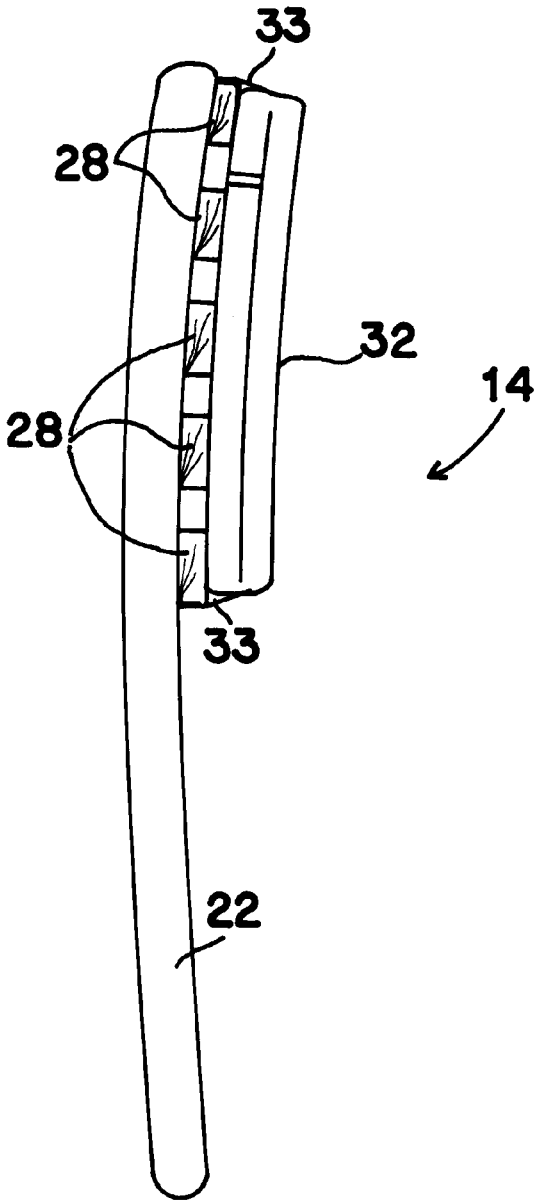
FIG. 11 is a side view of one embodiment of the second frame of the present invention.
Figure 13:
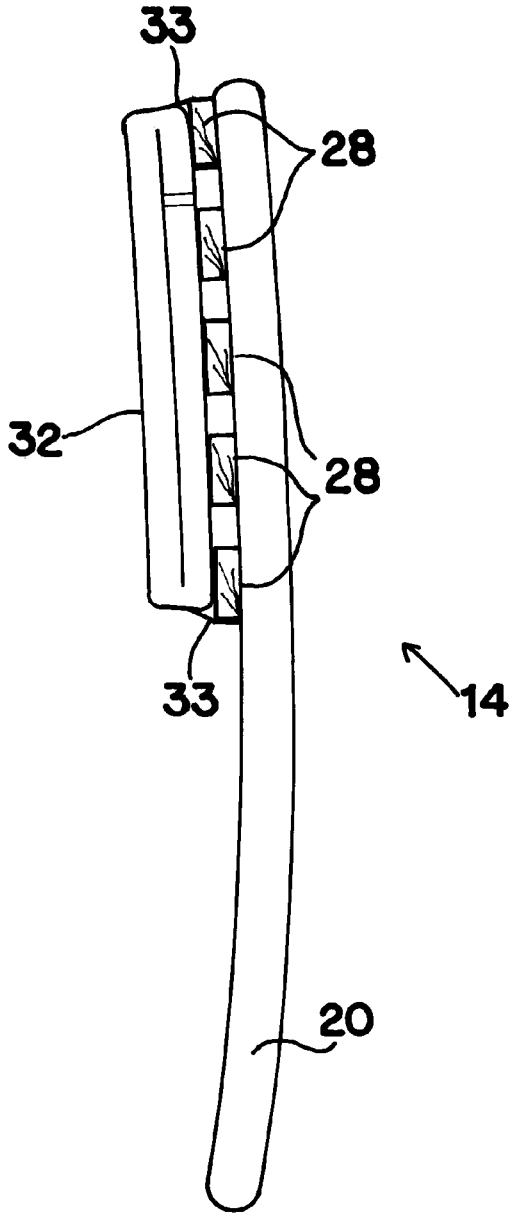
FIG. 13 is a side view of one embodiment of the second frame of the present invention.

Referring now to FIGS. 11 and 13, side views of one embodiment of the seat frame 14 of the present invention are shown. As with the back frame 12, the seat frame 14 legs 22 (and 20) are preferably generally slightly curved. Such curvature allows for proper fit with the curved legs 16, 18 of the back frame 12.

Figure 12:
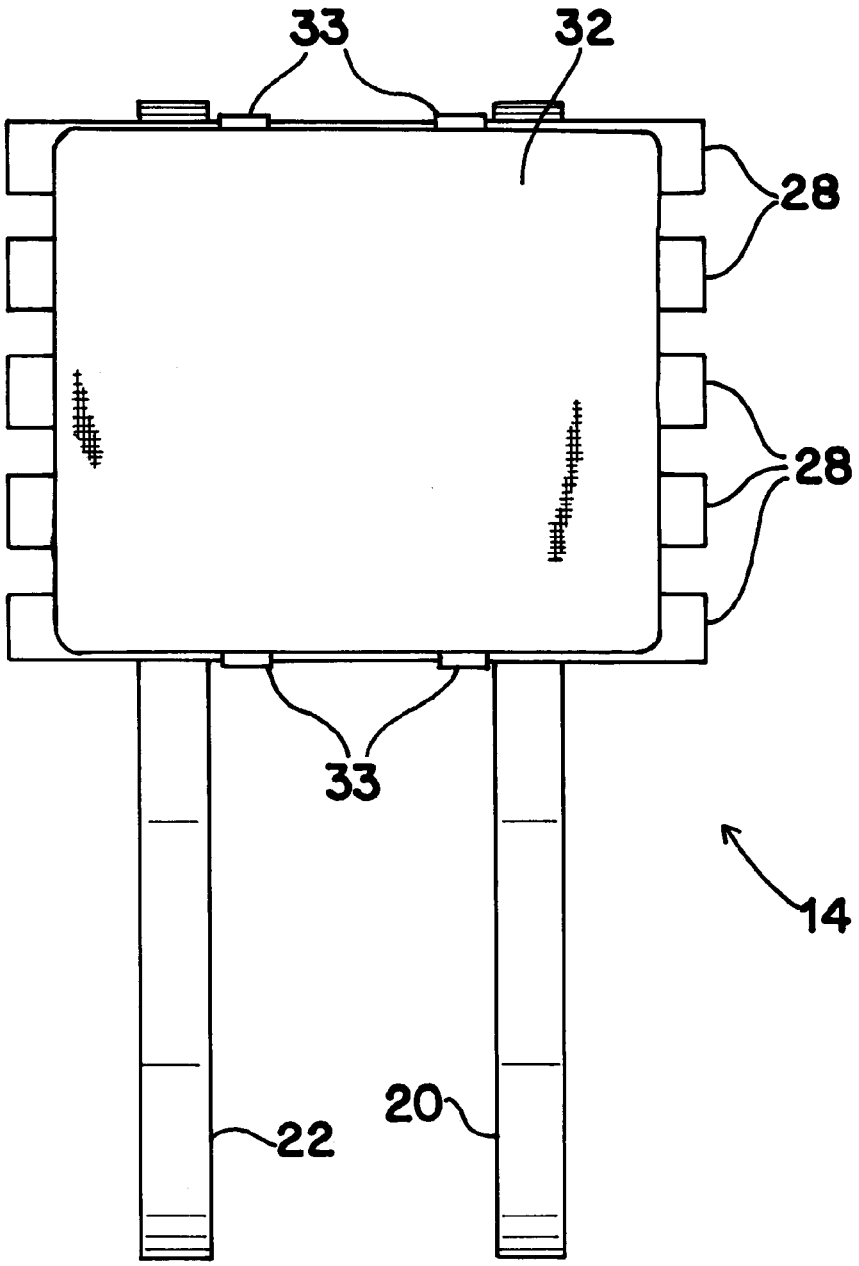
FIG. 12 is a front side view of one embodiment of the second frame of the present invention.
Figure 14:
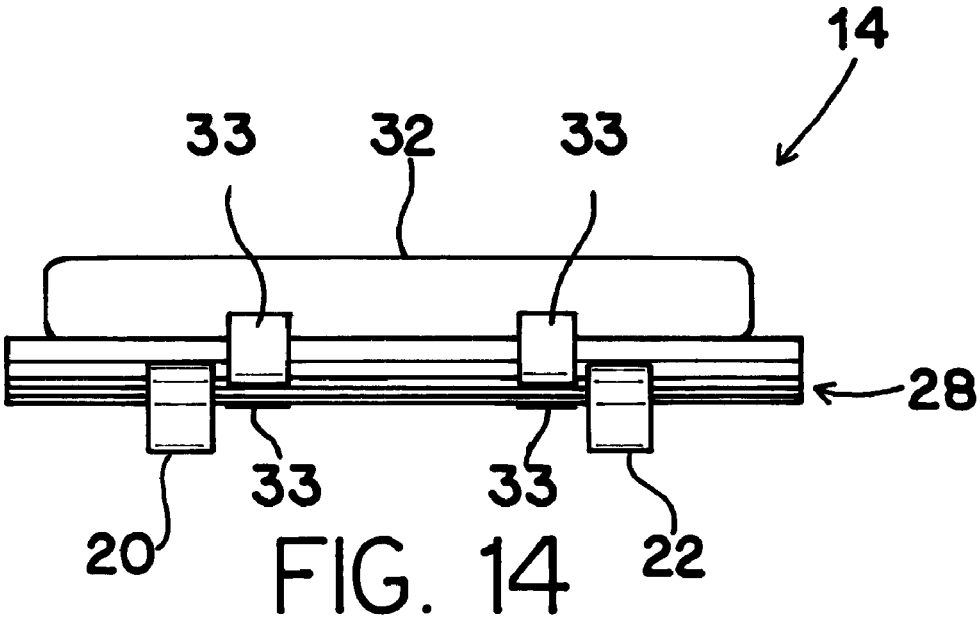
FIG. 14 is a top view of one embodiment of the second frame of the present invention.
Figure 15:
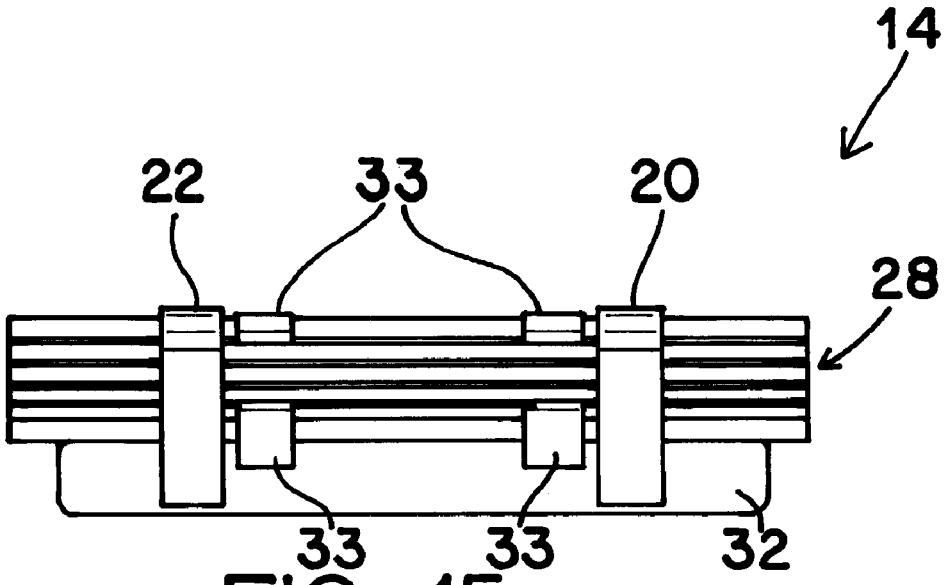
FIG. 15 is a bottom view of one embodiment of the second frame of the present invention.

FIG. 12 shows a front side view of the preferred back frame 12. FIG. 14 shows a top view of the preferred embodiment of seat frame 14. FIG. 15 shows a bottom view of the preferred embodiment of seat frame 14.

Figure 16:
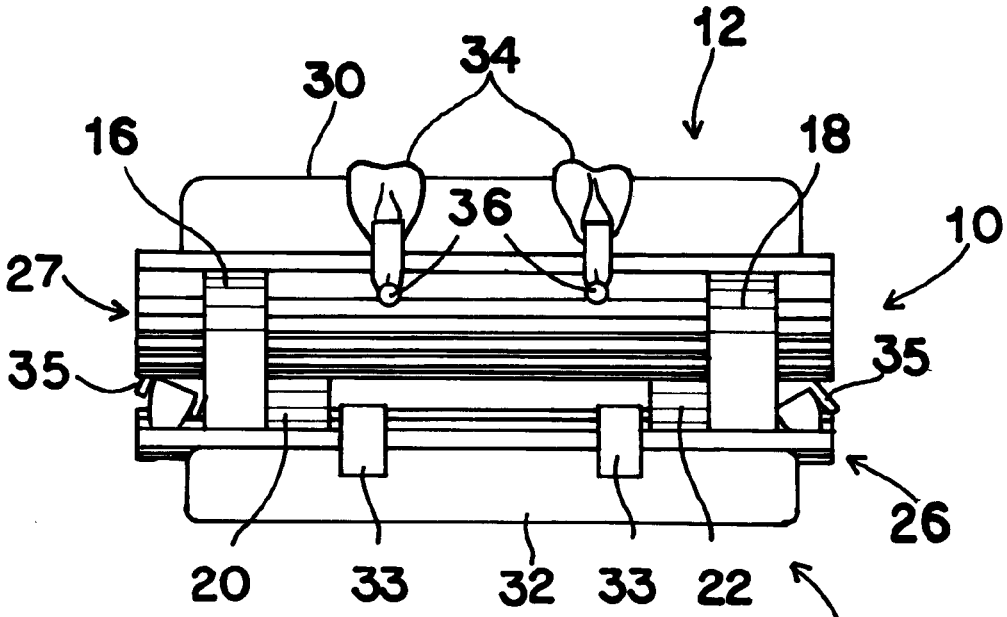
FIG. 16 is a top view of one embodiment of the present invention in its backpack mode.
Figure 17:
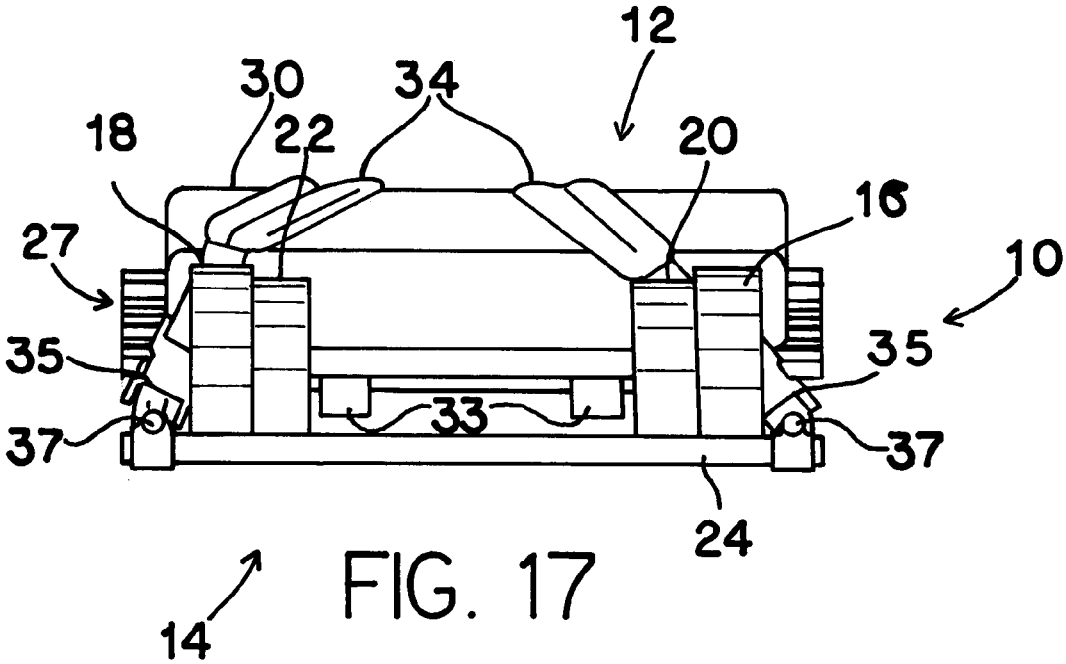
FIG. 17 is a bottom view of one embodiment of the present invention.

FIG. 16. shows a top view of the preferred embodiment of the present invention 10. This view shows the present invention 10 in its backpack mode, where the seat frame 14 nests inside the back frame 12. This view particularly shows the spacing of the inner legs 20, 22, in view of the spacing of the outer legs 16, 18. FIG. 17 further shows a bottom view of an embodiment of the present invention 10. This embodiment not having an attached seat cushion when in the backpack mode.

Generally, the present invention 10 has a first frame portion 12 and a second frame portion 14. These frame portions are separate units able to be fitted together so as to create both a backpack mode and a sitting chair mode. Such assembly requires no tools.

While the preferred embodiment uses two inner legs and two outer legs, other embodiments may be possible using as few as one outer leg or one inner leg, or a plurality of inner and outer legs.

There are two modes that the present invention is generally used in. The first is the backpack mode. In a backpack mode usage, the ends 21 of the first inner leg 20 and the second inner leg 22 are inserted through the second support portion or orifice 42 located within the back frame 12. Preferably the seat frame 14 will be slid into the back frame in a nested fashion so that the seat frame 14 is held nested in the back frame 12.

The second is the sitting chair mode. In the sitting chair mode, the ends 21 of the first inner leg 20 and the second inner leg 22 are inserted through the first support portion 40 in a manner that nests the inner legs 20, 22 with the outer legs 16, 18 of the back frame 12. Such a nesting is shown in FIGS. 1–2B, as well as in FIGS. 16–17.

Figure 18:
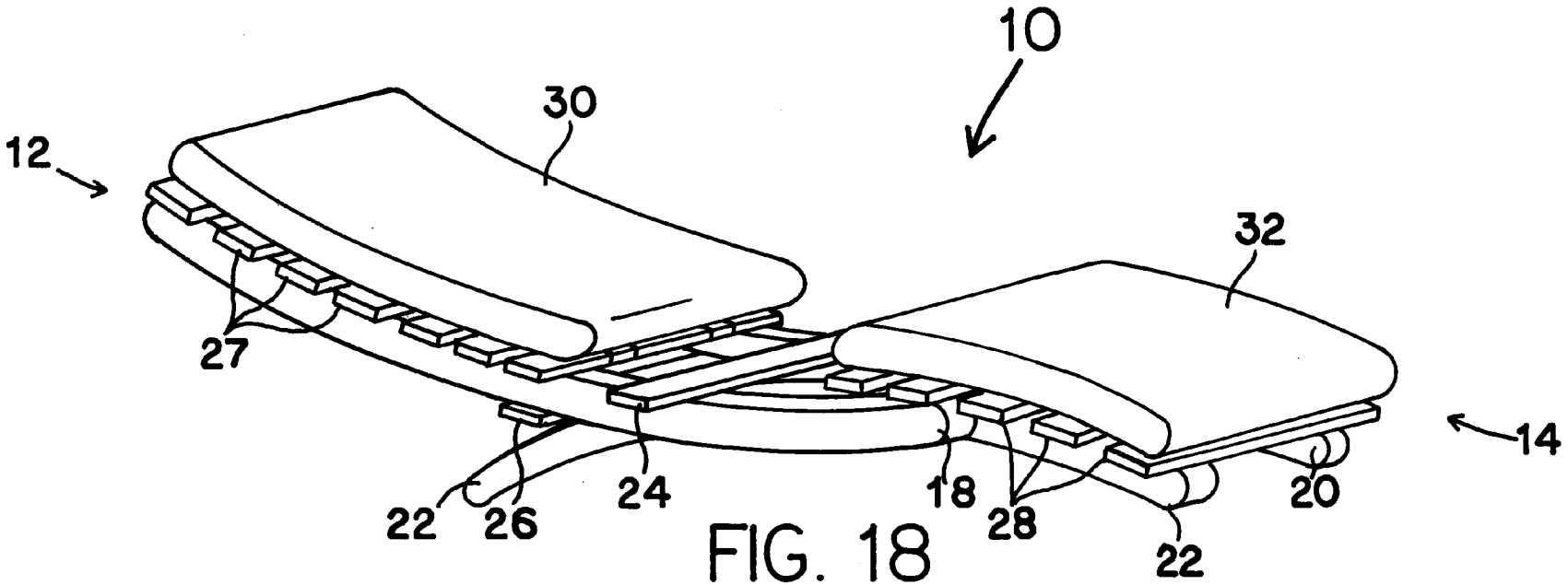
FIG. 18 is a side perspective view of one embodiment of the present invention in its reclining mode.

FIG. 18 shows one embodiment of the present invention used in the recliner mode. In this mode, the first and second inner legs 20, 22 are inserted below the upper support 26, and below the lower support 24 so that the end of the first and second outer legs 16, 18 rest against the seat frame cross piece members 27. This position is referred to as the third support position. In such an embodiment, the top and bottom ends of the first inner leg 20 and the second inner leg 22 serve as the legs of the recliner mode chair.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A convertible chair device, said device convertible in between a chair mode, a reclining mode, and a carrying mode, said device comprising:

a first frame portion, said first frame portion having at least one elongated leg extending therefrom, said first frame portion having a first support portion for receiving therethrough at least one second frame portion elongated leg, said first frame portion having a third support portion for receiving therethrough at least one second frame portion elongated leg, said first frame portion having a second support portion for receiving therethrough at least one second frame portion elongated leg in a generally parallel fashion;

a second frame portion not attached to said first frame portion, said second frame portion having at least one elongated leg extending therefrom for interfitting relationship with said first frame portion;

wherein said device is convertible to a sitting mode by insertion of said second frame portion elongated leg through said first support portion;

wherein said device is convertible into a reclining mode by insertion of said second frame portion elongated leg through said third support portion; and wherein said device is convertible to a carrying mode by insertion of said second frame portion elongated leg through said second support portion to form a cantilevered chair.

2. The device of claim 1, wherein said first frame portion further comprises a backrest.

3. The device of claim 1, wherein said second frame portion further comprises a seat.

4. The device of claim 1 further comprising at least one shoulder strap for allowing said device to be carried as a backpack.

5. A convertible backpack chair comprising:

a back frame, said back frame comprising a pair of generally parallel back legs, said back legs having a front side, a back side, a top end, and a bottom end, thereby defining a back frame front, a back frame back, a back frame top end, and a back frame bottom end, said back frame further comprising at least one parallel cross piece spanning between said back legs, said back frame cross piece normal to said back legs, said back frame cross piece attaching to said front side of said back legs, said back frame further comprising a lower support piece spanning between said back legs, said lower support piece parallel to said cross pieces, said lower support piece attaching to said back side of said back legs;

a seat frame, said seat frame comprising a pair of generally parallel seat legs, said seat legs having a front side, a back side, a top end, and a bottom end, thereby defining a seat frame front, a seat frame back, a seat frame top end, and a seat frame bottom end, said seat frame further comprising at least one parallel cross piece spanning between said seat legs, said seat frame cross piece perpendicular to said seat legs, said seat frame cross piece attaching to said back side of said seat legs;

wherein said seat frame nests with said back frame in a backpack mode; and, wherein said seat frame connects with said back frame in a sitting mode to form a chair.

6. The convertible backpack chair of claim 5 wherein said back legs are concavely curved on their front side, and convexly curved on their back side.

7. The convertible backpack chair of claim 5 wherein said back frame further comprises a back cushion attachment means, and a back cushion which attaches to said back frame at said back cushion attachment means.

8. The convertible backpack chair of claim 5 wherein said seat legs are concavely curved on their front side, and convexly curved on their back side.

9. The convertible backpack chair of claim 5 wherein said seat frame further comprises a seat cushion attachment means, and a seat cushion which attaches to said seat frame at said seat cushion attachment means.

10. The convertible backpack chair of claim 5 wherein the distance between the seat legs allows the seat legs to nest between the back legs, so that the back side of the seat frame nests against the back side of the back frame, thereby creating said backpack mode.

11. The convertible backpack chair of claim 5 wherein said seat frame attaches to said back frame in a nested fashion through the back frame cross piece located closest to said seat frame's bottom end resting upon the top surface of said lower support piece, said seat legs thus being held between said lower support piece and said back frame cross piece located closest to said seat frame's bottom end, thereby creating said chair.

12. The convertible backpack chair of claim 5 further comprising at least one shoulder strap attaching to said backpack chair for allowing said chair to be carried on a user's back.

13. A convertible backpack chair comprising:

a back frame, said back frame comprising a pair of generally parallel back legs, said back legs having a frontside, a backside, a first side, a second side, a top end, and a bottom end, thereby defining a back frame front, a back frame back, a back frame first side, a back frame second side, a back frame top end, and a back frame bottom end, in which said back legs are convexly curved on their front side, and concavely curved on their back side, said back frame further comprising a plurality of parallel cross pieces spanning between said back legs, said cross pieces being normal to said back legs, said cross pieces attaching to said front side of said back legs, said back frame further comprising a lower support piece spanning between said back legs, said lower support piece parallel to said cross pieces, said lower support piece attaching to said back side of said back legs, and a seat frame, said seat frame comprising a pair of generally parallel seat legs, said seat legs having a frontside, a backside a first side, a second side, a top end, and a bottom end, thereby defining a seat frame front, a seat frame back, a seat frame first side, a seat frame second side, a seat frame top end, and a seat frame bottom end, said seat legs are convexly curved on their back side, and concavely curved on their front side, said seat frame further comprising a plurality of parallel cross pieces spanning between said seat legs, said seat frame cross pieces being normal to said seat legs, and said seat frame cross pieces attaching to said back side of said seat legs;

wherein the distance between the seat legs allows the seat legs to nest between the back legs, so that the back side of the seat frame faces the back side of the back frame;

wherein said seat frame attaches to said back frame in a nested fashion through the cross piece located closest to the seat frame's bottom end resting upon the top surface of the lower support piece, the seat legs thus being held between the lower support piece and the bottom cross piece located on the back frame to form a generally flat form for a carrying mode;

at least one shoulder strap attaching to said backpack chair for allowing said chair to be carried on a user's back; and a sitting mode in which a cantilevered chair is formed by insertion of said seat legs through said back frame, so that the bottom ends of said seat legs form the rear legs of said chair, and the bottom ends of said back legs form the front legs of said chair.

* * * * *